US007140049B2

(12) United States Patent
Lang-Ree et al.

(10) Patent No.: US 7,140,049 B2
(45) Date of Patent: Nov. 28, 2006

(54) HELMET PROTECTION SYSTEM

(75) Inventors: Arne Lang-Ree, Los Gatos, CA (US); Hilgard N. Muller, Felton, CA (US)

(73) Assignee: Bell Sports, Inc., Irving, TX (US)

( * ) Notice: Subject to any disclaimer, the term of this patent is extended or adjusted under 35 U.S.C. 154(b) by 65 days.

(21) Appl. No.: 10/911,243

(22) Filed: Aug. 3, 2004

(65) Prior Publication Data

US 2006/0026742 A1 Feb. 9, 2006

(51) Int. Cl.
*A42B 3/00* (2006.01)

(52) U.S. Cl. ..... 2/412

(58) Field of Classification Search ..... 2/410, 2/411, 412, 414, 425

See application file for complete search history.

(56) References Cited

U.S. PATENT DOCUMENTS

| | | | | | |
|---|---|---|---|---|---|
| 3,213,463 | A | * | 10/1965 | Marchello | 2/420 |
| 3,703,750 | A | * | 11/1972 | Irwin, Jr. | 24/265 R |
| 3,905,546 | A | * | 9/1975 | Gooding | 2/414 |
| 3,935,044 | A | * | 1/1976 | Daly | 156/79 |
| 4,006,496 | A | * | 2/1977 | Marker | 2/414 |
| 4,385,025 | A | * | 5/1983 | Salerno et al. | 264/255 |
| 4,901,373 | A | * | 2/1990 | Broersma | 2/421 |
| 4,970,729 | A | * | 11/1990 | Shimazaki | 2/414 |
| 4,996,724 | A | * | 3/1991 | Dextrase | 2/411 |
| 5,007,141 | A | | 4/1991 | Gentes | 24/163 R |
| 5,099,523 | A | | 3/1992 | Broersma | 2/411 |
| 5,119,516 | A | | 6/1992 | Broersma | 2/411 |
| 5,269,025 | A | | 12/1993 | Broersma | 2/411 |
| 5,351,341 | A | | 10/1994 | Broersma | 2/412 |
| 5,469,583 | A | | 11/1995 | Akeley et al. | 2/421 |
| 5,477,563 | A | | 12/1995 | Gentes et al. | 2/411 |
| 5,481,762 | A | | 1/1996 | Gentes et al. | 2/411 |
| 5,619,756 | A | * | 4/1997 | Garneau | 2/425 |
| 5,659,900 | A | | 8/1997 | Arney et al. | 2/417 |
| 5,675,843 | A | | 10/1997 | Grim et al. | 2/422 |
| 5,729,877 | A | | 3/1998 | Kong et al. | 24/625 |
| 5,774,901 | A | | 7/1998 | Minami | 2/421 |
| 5,794,801 | A | * | 8/1998 | Lemelson | 428/698 |
| 5,833,796 | A | * | 11/1998 | Matich | 156/285 |
| 5,887,288 | A | | 3/1999 | Arney et al. | 2/421 |
| 6,009,561 | A | | 1/2000 | Bullock et al. | 2/422 |
| 6,009,562 | A | | 1/2000 | Bullock et al. | 2/422 |
| 6,401,261 | B1 | | 6/2002 | Arney et al. | 2/421 |
| 6,449,776 | B1 | | 9/2002 | Musal | 2/418 |
| 6,910,228 | B1 | * | 6/2005 | Tanaka | 2/424 |
| 2005/0069692 | A1 | * | 3/2005 | Ito | 428/304.4 |

FOREIGN PATENT DOCUMENTS

| | | | |
|---|---|---|---|
| JP | 63062715 A | * | 3/1988 |
| JP | 01132809 A | * | 5/1989 |
| JP | 2005112319 A | * | 4/2005 |
| WO | WO 9626654 A1 | * | 9/1996 |

* cited by examiner

*Primary Examiner*—Rodney Lindsey
(74) *Attorney, Agent, or Firm*—Baker Botts L.L.P.

(57) ABSTRACT

According to some embodiments of the invention, a system for protecting a device formed from polystyrene is provided. The system includes a body formed from polystyrene. The system also includes a protective layer formed from thermoplastic elastomer. The protective layer is coupled to the body during a molding process used to form the body.

7 Claims, 2 Drawing Sheets

HELMET PROTECTION SYSTEM

TECHNICAL FIELD OF THE INVENTION

This invention relates generally to protective gear and more particularly to a helmet protection system.

BACKGROUND OF THE INVENTION

A physical impact to the head of a person may cause serious injury or death. To reduce the probability of such consequences, protective gear, such as a helmet, is often used in activities that are associated with an increased level of risk for a head injury. Examples of such activities include, but are not limited to, skiing, snowboarding, bicycling, rollerblading, rock climbing, skate boarding, and motorcycling.

SUMMARY OF THE INVENTION

According to some embodiments of the invention, a system for protecting a device formed from polystyrene is provided. The system includes a body formed from polystyrene. The system also includes a protective layer formed from thermoplastic elastomer. The protective layer is coupled to the body during a molding process used to form the body.

Some embodiments of the invention provide numerous technical advantages. Other embodiments may realize some, none, or all of these advantages. For example, according to one embodiment, a helmet is protected by providing a protective layer over areas of a helmet body that are likely to be damaged by dropping or use of the helmet, such as a rim portion of the helmet body. Such protective layers may be especially advantageous for protecting the softer, "foam-like" portions of the helmet.

Other advantages may be readily ascertainable by those skilled in the art.

BRIEF DESCRIPTION OF THE DRAWINGS

Reference is now made to the following description taken in conjunction with the accompanying drawings, wherein like reference numbers represent like parts, in which.

DETAILED DESCRIPTION OF EXAMPLE EMBODIMENTS OF THE INVENTION

Embodiments of the invention are best understood by referring to FIGS. 1–4 of the drawings, like numerals being used for like and corresponding parts of the various drawings.

Figure 1:
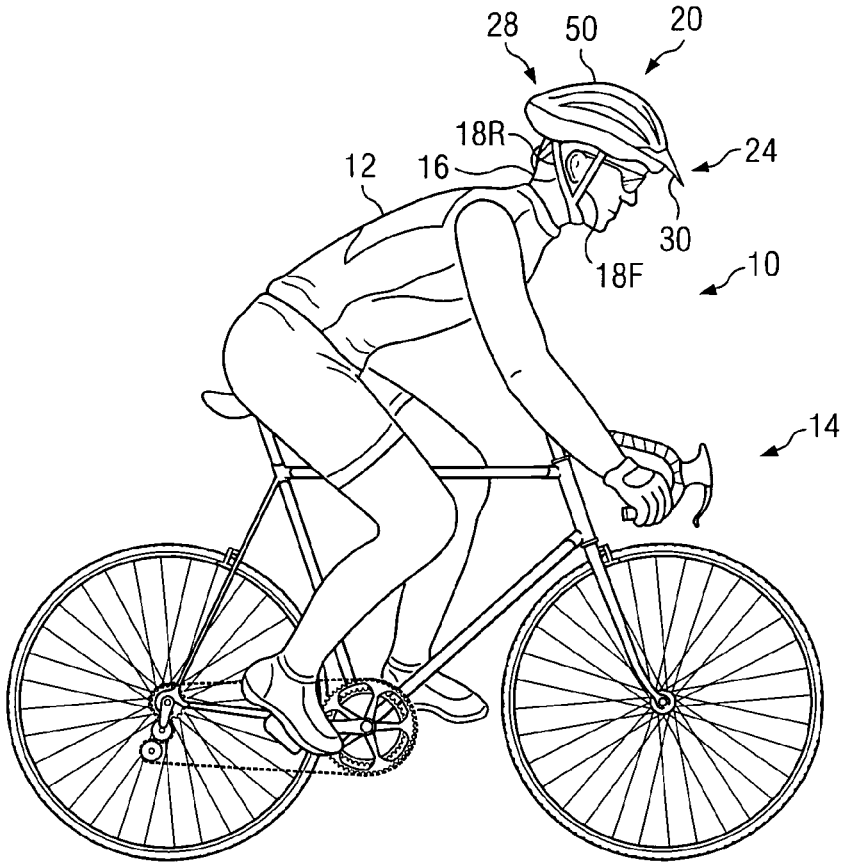
FIG. 1 is a diagram illustrating one embodiment of an environment in which a helmet may be used.

FIG. 1 is a schematic diagram illustrating one embodiment of an environment 10 in which a helmet 20 according to one or more embodiments of the present invention may be used. As shown in FIG. 1, environment 10 includes a bicyclist (user) 12 riding a bicycle 14 and wearing helmet 20 on a head 16 of user 12. Helmet 20 comprises a body 50, a front portion 24, a rear portion 28, a visor 30 coupled to front portion 24, front straps 18F, and rear straps 18R. Helmet 20 is secured to head 16 through the use of front straps 18F and rear straps 18R, which are collectively referred to as straps 18. The term "helmet" is used in this document to include any type of protective head gear, such as a bicycle helmet, a motorcycle helmet, and a hard hat. Although helmet 20 is used as an example to describe some embodiments of the present invention, any type of helmet, both protective and non-protective, may benefit from the teachings of the present invention. Furthermore, as described below, embodiments of the present invention may also be used in conjunction with products other than helmets.

Referring again to FIG. 1, if user 12 were to accidentally fall off of bicycle 14, user 12 may suffer various injuries, including an impact to head 16. Because the use of a protective head gear such as helmet 20 may reduce the severity of trauma to head 16 in case of an impact, the use of helmet 20 is strongly encouraged for many activities where the probability of injury to head 16 is relatively high.

A body of a protective headgear, such as helmet 20, is generally formed from a shock-absorbing material, such as expanded polystyrene (EPS). The surface of a body formed from EPS may be easily dented, scratched or otherwise damaged, which may compromise the ability of the helmet to offer protection against impact and/or present an unattractive appearance. To protect against such a damage, a hard plastic shell may be provided over the outer surface of the helmet body. However, portions of the existing helmet are not protected with such a shell because of certain manufacturing, cost, comfort, or other limitations. For example, the bottom rim of a helmet body may be unprotected.

According to some embodiments of the present invention, a system for protecting a helmet from damage is provided by providing one or more protective layers over portions of a helmet body that are associated with a relatively high risk of damage, such as a rim portion of a helmet. This is advantageous because the level of durability of a helmet is improved while maintaining the capacity of the helmet to protect the wearer's head. Additional details of example embodiments of the invention are described below in greater detail in conjunction with FIGS. 2–4.

Figure 2:
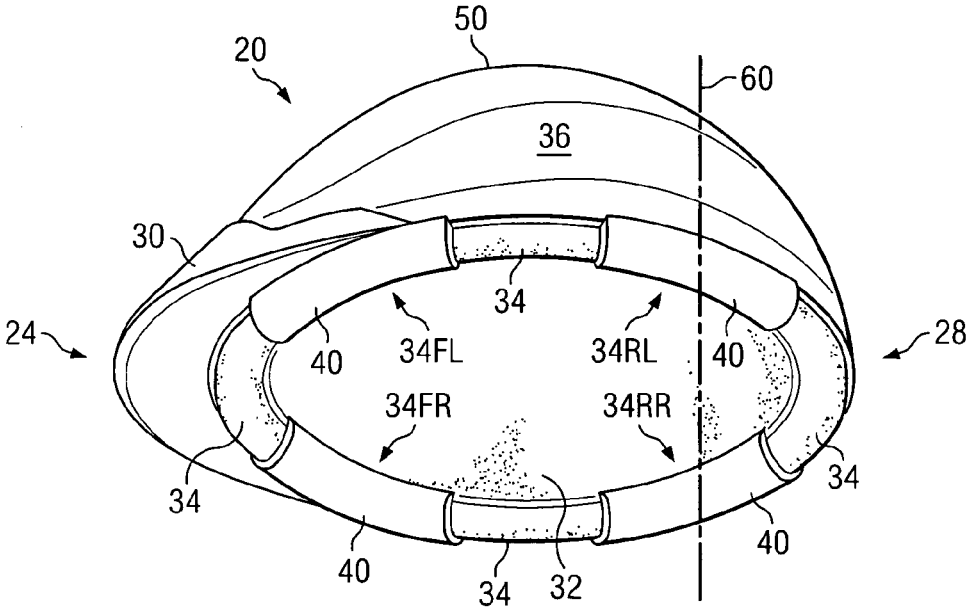
FIG. 2 is a schematic diagram illustrating a perspective view of one embodiment of a protective layer that is disposed over a rim portion of the helmet shown in FIG. 1.
Figure 3:
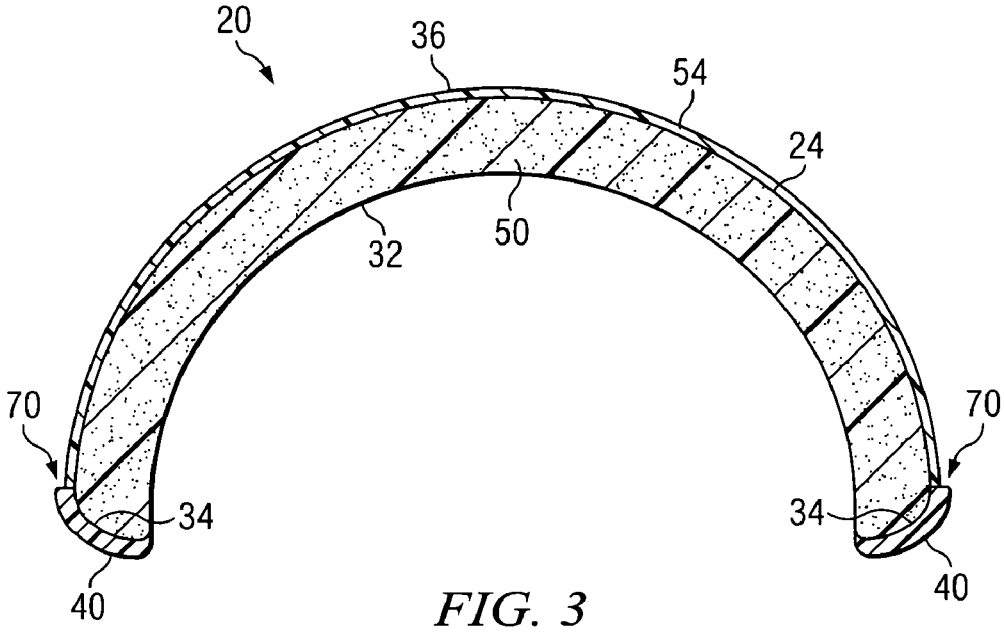
FIG. 3 is a schematic diagram illustrating a cross-section of the helmet and the protective layer shown in FIG. 2.

FIG. 2 is a schematic diagram illustrating a perspective view of helmet 20 that may benefit from the teachings of the present invention. FIG. 3 is a schematic diagram illustrating a cross-section of helmet 20 at a phantom line 60 shown in FIG. 2. Referring to FIG. 2, helmet 20 comprises a body 50, an outer surface 36, an inner surface 32 that defines a bowl-shaped chamber, and a rim portion 34 that is disposed between outer surface 36 and inner surface 32 at the bottom of the helmet. Rim portion 34 comprises a front left rim portion 34FL, a front right rim portion 34FR, a rear left rim portion 34RL, and a rear right rim portion 34RR. Front left rim portion 34FL, front right rim portion 34FR, rear left rim portion 34RL, and rear right rim portion 34RR may also be referred to as front left corner portion 34FL, front right corner portion 34FR, rear left corner portion 34RL, and rear right corner portion 34RR, respectively. In certain embodiments, although not explicitly shown in FIG. 2, helmet 20 may comprise ventilation holes, internal/external support structures, and/or other suitable components, such as a helmet retention system and a helmet fitting system.

Referring to and as shown in FIG. 3, body 50 comprises an outer surface 24 to which a shell 54 may be coupled. Thus, in certain embodiments, outer surface 36 of shell 54 constitutes outer surface 36 of helmet 20. However, where shell 54 is omitted from helmet 20, outer surface 24 constitutes the outermost surface of helmet 20. Body 50 may be formed from any suitable material, such as EPS. Rim portion 34 and inner surface 32 are parts of body 50, and thus are formed from the same material, such as EPS. Shell 54 may be formed from any suitable material that is operable to resist damage and wear. An example of such a material includes, but is not limited to, polycarbonate plastic. Shell 54 may be used to add color, patterns, pictures, and/or any other suitable design to helmet 20.

Referring to FIGS. 2 and 3, according to certain embodiments of the invention, one or more protective layers 40 may be positioned over some or all of rim portion 34. This is advantageous in some embodiments because rim portion 34 is generally impractical to cover with shell 54 due to manufacturing, cost, comfort, or other limitations. Protective layer 40 may be formed from a thermoplastic elastomer (TPE) or any other suitable material. In some embodiments, protective layer 40 may be formed from a styrene-based TPE. Using certain types of TPE, such as styrene-based TPE, to form protective layer 40 is advantageous in some embodiments where body 50 of helmet 20 is molded out of EPS because such protective layer 40 can be in-molded with body 50 and also adheres well to EPS. However, embodiments using other types of TPE, including olefin-based TPE, are also envisioned. In certain embodiments, protective layer 40 may cover certain portions (or all) of outer surface 24 of body 50 that are not covered by shell 54. In certain embodiments, protective layer 40 may overlap shell 54. Although rim portion 34 is used as an example area of body 50 that may be protected by protective layer 40, any area of body 50 of helmet 20 where body 50 is exposed and/or that is associated with a relatively high risk of damage may be covered using protective layer 40. Although TPE is described as one example material that may be used to form protective layer 40, any material that is resistant to dents, scratches, and does not create comfort issues may be used to form protective layer 40. In some embodiments, protective layer 40 may be formed from a material that is softer and/or more pliable than shell 54.

In certain embodiments, separate pieces of protective layers 40 may be distributed to different portions of rim portion 34. For example, as shown in FIG. 2, separate pieces of protective layers 40 are positioned at front left rim portion 34FL, front right rim portion 34FR, rear left rim portion 34RL, and rear right rim portion 34RR. This is advantageous in certain embodiments because helmets having different sizes can be manufactured using protective layers 40 having the same size, which simplifies the manufacturing process. For example, regardless of the size of helmet 20, the placement of protective layers 40 can be adjusted to accommodate the different sizes of rim portions 34 by either being positioned closer together (for smaller sizes) or farther apart (for larger sizes).

Referring to FIG. 3, in certain embodiments, protective layer 40 may be configured so that a portion of protective layer 40 extends further outwardly from body 50 than does shell 54, as indicated by an arrow 70. This is advantageous in some embodiments because the clam shell used to mold helmet 20 may bear down on the protruding portion of protective layer 40, indicated by arrow 70, to maintain the position of protective layer 40 during the molding process.

Figure 4:
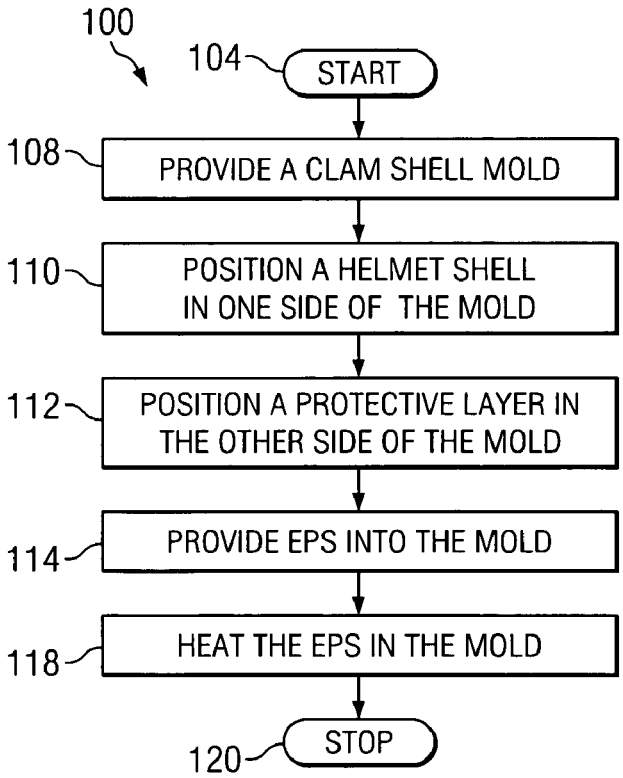
FIG. 4 is a flowchart illustrating one embodiment of a method for providing the protective layer for the helmet shown in FIGS. 2 and 3.

FIG. 4 is a flowchart illustrating one embodiment of a method 100 for providing protective layer 40 for helmet 20 shown in FIGS. 2 and 3. Method 100 starts at step 104. At step 108, a clam shell mold having a male side and a female side each defining a portion of a chamber that has a shape of helmet 20 is provided. At step 110, shell 54 is positioned in one side of the mold (typically the female side, although this is not required) in a manner well known to one skilled in the art. A suitable material, such as polycarbonate plastic, may be used to form shell 54. Step 110 may be omitted in some embodiments. At step 112, protective layer 40 is positioned in desired locations of the mold. For example, protective layer 40 is positioned in a male side of the clam shell mold; however, in some embodiments, protective layer 40 may be positioned in a female side of the clam shell mold. In certain embodiments, step 112 may be performed before step 110 or in conjunction with step 110. At step 114, a suitable material for forming body 50 of helmet 20, such as EPS, may be provided into the mold. For example, negative pressure may be created in the chamber defined by the mold and EPS may be pressure-filled into the chamber. At step 118, EPS in the chamber of the mold is heated to form body 50 of helmet 20, thus in-molding protective layer 40 with body 50 of helmet 20. EPS may be heated in any suitable method. For example, EPS may be exposed to steam. In certain embodiments, heating step 118 may be performed while performing step 114. Method 100 stops at step 120.

Although a helmet, such as helmet 20, is used as an example device that may benefit from the teachings of the present invention, any device that is molded out of a shock-absorbing and/or insulation material, such as EPS, that is relatively easily damaged may benefit from the teachings of the present invention. For example, a portable cooler and a beverage holder formed from EPS may benefit from the use of a protective layer to protect against surface and body damage.

Although some embodiments of the present invention have been described in detail, it should be understood that various changes, substitutions, and alterations can be made hereto without departing from the spirit and scope of the invention as defined by the appended claims.

What is claimed is:

1. A system for head protection, comprising:

a helmet body having an exterior surface, an interior surface, and a rim portion disposed between the exterior and the interior surfaces;

a plastic shell coupled to the external surface of the helmet body; and a protective layer coupled to the rim portion, the protective layer formed from a softer material than the plastic shell.

2. The system of claim 1, wherein the helmet body is formed from expanded polystyrene.

3. The system of claim 1, wherein the protective layer is formed from a thermoplastic elastomer.

4. The system of claim 1, wherein the plastic shell is formed from polycarbonate plastic.

5. The system of claim 1, wherein the protective layer extends further outwardly from the helmet body than an exterior surface of the plastic shell.

6. A helmet, comprising:

a helmet body formed from polystyrene; and a protective layer formed from thermoplastic elastomer coupled to the helmet body during a molding process used to form the helmet body.

7. The helmet of claim 6, wherein the protective layer is an outermost surface of the helmet.

* * * * *